US007487592B2

(12) United States Patent
Koike

(10) Patent No.: US 7,487,592 B2
(45) Date of Patent: Feb. 10, 2009

(54) ELECTRIC ROTARY SHAVER

(75) Inventor: Hideaki Koike, Matsumoto (JP)

(73) Assignee: Izumi Products Company, Nagano (JP)

( * ) Notice: Subject to any disclaimer, the term of this patent is extended or adjusted under 35 U.S.C. 154(b) by 224 days.

(21) Appl. No.: 11/114,437

(22) Filed: Apr. 26, 2005

(65) Prior Publication Data

US 2005/0241153 A1 Nov. 3, 2005

(30) Foreign Application Priority Data

Apr. 27, 2004 (JP) ..... 2004-131649

(51) Int. Cl.
*B26B 19/14* (2006.01)

(52) U.S. Cl. ..... 30/43.4; 30/43.6; 30/64; 30/66

(58) Field of Classification Search ..... 30/43.4–43.6, 30/64, 66–68, 346.51
See application file for complete search history.

(56) References Cited

U.S. PATENT DOCUMENTS

| | | | | |
|---|---|---|---|---|
| 3,844,033 | A * | 10/1974 | Yonkers | 30/43.5 |
| 3,913,225 | A * | 10/1975 | Tietjens et al. | 30/43.6 |
| 4,001,932 | A * | 1/1977 | Herrick | 30/43.5 |
| 4,077,120 | A * | 3/1978 | Herrick et al. | 30/43.5 |
| 4,087,909 | A * | 5/1978 | Naemura | 30/43.6 |
| 4,137,629 | A * | 2/1979 | Yamazaki | 30/43.5 |
| 4,168,570 | A * | 9/1979 | Bakker et al. | 30/43.6 |
| 4,318,223 | A * | 3/1982 | Bergsma et al. | 30/43.6 |
| 4,711,028 | A * | 12/1987 | Bergsma et al. | 30/43.6 |
| 4,896,421 | A * | 1/1990 | Geertsma et al. | 30/43.6 |
| 4,910,869 | A * | 3/1990 | Labrijn | 30/43.6 |
| 5,012,577 | A * | 5/1991 | Bosch | 30/43.6 |
| 6,226,870 | B1 * | 5/2001 | Barish | 30/43.6 |
| 6,647,626 | B2 * | 11/2003 | Nakano | 30/43.4 |
| 6,671,960 | B2 * | 1/2004 | Kawafune et al. | 30/43.6 |
| 6,722,038 | B2 * | 4/2004 | Visman et al. | 30/43.6 |
| 6,823,590 | B2 * | 11/2004 | Uchiyama et al. | 30/43.6 |
| 7,152,324 | B2 * | 12/2006 | Uchiyama | 30/43.6 |
| 7,222,428 | B2 * | 5/2007 | Koike | 30/43.5 |
| 2006/0260130 | A1 * | 11/2006 | Shimizu | 30/43.6 |
| 2007/0084059 | A1 * | 4/2007 | Hannan et al. | 30/43.5 |
| 2007/0089298 | A1 * | 4/2007 | Shimizu | 30/43.6 |
| 2007/0124936 | A1 * | 6/2007 | Okabe | 30/43.6 |

(Continued)

FOREIGN PATENT DOCUMENTS

EP 606000 A1 * 7/1994

(Continued)

*Primary Examiner*—Jason Daniel Prone
(74) *Attorney, Agent, or Firm*—William L. Androlia; H. Henry Koda

(57) ABSTRACT

An electric shaver including an outer cutter holder (30) that holds the outer cutters (24), an inner cutter holder (42) which has a plurality of projections (50) that pass through the outer cutter holder (30) and press the outer circumferential edges of the outer cutters (24) and which holds the inner cutters (36) so that the inner cutters are rotatable, a single shaft member (62) which passes through the inner cutter holder (42) and outer cutter holder (30) and whose tip end is positioned in the cutter frame (20) so as to be located between the mutually adjacent outer cutters (24), and a cutter retaining assembly (60), which the shaft member (62) passes through and is detachably anchored to the cutter frame (20) and further elastically presses the inner cutter holder (42) toward the outer cutters.

5 Claims, 7 Drawing Sheets

U.S. PATENT DOCUMENTS

| | | | | |
|---|---|---|---|---|
| 2007/0256302 | A1* | 11/2007 | Okabe | 30/43.6 |
| 2008/0072429 | A1* | 3/2008 | Uchiyama | 30/43.6 |

FOREIGN PATENT DOCUMENTS

| | | | | |
|---|---|---|---|---|
| EP | 1591211 | A1 | * | 11/2005 |
| EP | 1637293 | A1 | * | 3/2006 |
| JP | 60-253484 | | | 12/1985 |
| JP | 2-14748 | | | 4/1990 |
| JP | 02-252487 | | | 10/1990 |
| JP | 2002-159764 | | | 6/2002 |
| JP | 2005312523 | A | * | 11/2005 |
| JP | 2006087509 | A | * | 4/2006 |

* cited by examiner

ELECTRIC ROTARY SHAVER

BACKGROUND OF THE INVENTION

1. Technical Field

The present invention relates to an electric rotary shaver in which inner cutters rotate while being caused to be in contact with substantially circular disk form outer cutters, so that hair that advances into the slits in the outer cutters is cut by the inner cutters.

2. Description of the Related Art

Electric rotary shavers that have a plurality of outer cutters are known widely. In one type of such electric shavers, two outer cutters are installed side by side in close proximity; and in another type, three outer cutters are installed at vertices of an imaginary equilateral triangle. In these electric rotary shavers, in order to improve the cutting ability, the respective outer cutters are provided so that they are independently movable in the axial direction and tiltable, so that the outer cutters move in conformity to the curvature of the shaving surface.

Japanese Patent No. 2853812 discloses a shaver in which the shaving units that have inner cutters provided in outer cutters are mounted on a holding plate, and this holding plate is fastened to the inside walls of a cutter frame (holder). The holding plate comprises a plurality of arms that advance and retract from the center toward the outside and vice-versa, and the distal ends of the arm elements are engaged with and disengaged from the inside walls of the cutter frame. The shaving units are mounted on the holding plate laterally from the sides; and in the mounted state, the shaving units are elastically held by elastic arms formed as an integral part of the holding plate so that the shaving units are movable slightly upward and downward.

In the above-described electric shaver which has thus two outer cutters, the holding plate is held on the inside walls of the cutter frame. However, no electric shaver in which the holding plate is held in the cutter frame between two outer cutters is known.

In the electric shaver disclosed in Japanese Utility Model Publication No. H02-14748, the entire outer circumferential edges of the outer cutters are retained by a holding body that holds the inner cutters, and this holding body is pressed against the outer cutters by springs. More specifically, a locking body is detachably mounted on the cutter frame, the locking body is provide with a plurality of anchoring rods that protrude in the radial direction, and the anchoring rods are engaged with and disengaged from the cutter frame; and in addition, the holding body is pressed by a spring that is installed in the locking body.

FIG. 8 shows the internal structure of the cutter frame of a conventional electric shaver (which are not of the above-described prior art), and FIG. 9 shows the cross section of this cutter frame.

In this electric shaver, three round outer cutters 1 are installed in the outer cutter holder 2 so that they are positioned at vertices of an imaginary equilateral triangle, and the respective outer cutters 1 are anchored to the outer cutter holder 2 so that they are movable in the axial direction and tiltable. The reference numeral 3 is an inner cutter holder, and three inner cutters 4 are provided in a freely rotatable manner. In this inner cutter holder 3, two projections 5 are provided so that they protrude in positions separated in the circumferential direction of the outer cutter 1 for each outer cutter 1, thus preventing the projections 5 from interfering with the outer cutter holder 2.

The center of the inner cutter holder 3 is elastically supported on the cutter frame 7 by a locking bolt 6. In other words, a nut 8 is inserted in the center of the cutter frame 7, and the inner cutter holder 3 and a compression coil spring 11 are disposed between a knob 10 and a locking ring 9 anchored to the locking bolt 6. The inner cutter holder 3 is pressed toward the locking ring 9 (i.e., toward the tip end of the locking bolt 6) by the coil spring 11.

In the structure described above, when the tip end of the locking bolt 6 is screwed into the nut 8, the inner cutter holder 3 elastically presses the outer cutters 1 by the coil spring 11. In other words, the circumferential edges of the outer cutters 1 are pressed by the coil spring 11 via the inner cutter holder 3 which forms an integral unit with the projections 5.

When the cutter frame 7 is mounted on the shaver main body (not shown), the inner cutters 4 are connected to the drive shaft (not shown in the figures) of a motor installed inside the shaver main body and rotated. This drive shaft is allowed to advance and retract in the axial direction with a return habit in the direction of protrusion, so that the drive shaft elastically presses the inner cutters 4 against the inside surfaces of the outer cutters 1. Furthermore, three supporting projections 12 (only one is shown in FIG. 9) that support the outer cutter holder 2 in the vicinity of the vertices of an equilateral triangle are formed on this shaver main body in a protruded fashion.

In the electric shaver disclosed in the Japanese Patent No. 2853812, the range of possible movement of the shaving units consisting of the outer cutters and inner cutters (i.e., the range of axial movement and the tilting range) is limited to the range of possible movement of the elastic arms that form integral parts of the holding plate, and thus this range of possible movement is unavoidably extremely small. As a result, the outer cutters cannot sufficiently conform to the indentations and projections and also the inclinations of the shaving surface (skin). Thus, the problem is that the shaver does not have good shaving characteristics.

In the electric shaver shown in the Japanese Utility Model Publication (Kokoku) No. H02-14748, a holding plate that holds the inner cutters is elastically pressed against the outer cutters. Accordingly, upward and downward movement of the outer cutter is accomplished by the longitudinal displacement of this holding plate. However, when the holding plate is removed upon clean of shaving debris, the outer cutters fall out of the cutter frame. Accordingly, in cases where the number of outer cutters is large (e.g., three), attachment and detachment of the outer cutters are bothersome, and handling of the outer cutters is thus difficult.

In addition, in the electric shaver of Japanese Utility Model Publication (Kokoku) No. H02-14748, since the entire outer circumferential edges of the outer cutters are pressed by the holding plate, the holding plate is greatly offset by even a slight displacement of one of the outer cutters, thus affecting the holding of the other outer cutters.

In the conventional example shown in FIGS. 8 and 9, the nut 8 into which the tip end of the locking bolt 6 is screwed is inserted in the cutter frame 7, and this area is surrounded by the outer cutter holder 2. Accordingly, it is necessary to increase the spacing between the outer cutters 1 in the vicinity of this nut 8; and in the case of a shaver that includes three outer cutters, the spacing of the respective outer cutters needs to be sufficiently large, or the diameter of the respective outer cutters needs to be sufficiently large. This, however, causes a problem, which is an increase in the size of the cutter frame. Likewise, in the case of a shaver that involves two outer cutters, the spacing of the outer cutters needs to be large. Thus, the problem in the structure of FIGS. 8 and 9 is serious.

BRIEF SUMMARY OF THE INVENTION

The present invention is to solve the problems seen in the prior art electric rotary shavers.

It is an object of the present invention to provide an electric rotary shaver that includes outer cutters that has an increased range of movement.

It is another object of the present invention to provide an electric rotary shaver that uses reduced number of parts required and has a reduced weight and size by a simple structure.

It is still another object of the present invention to provide an electric rotary shaver in which the reduction in size is accomplished also by way of narrowing the spacing between the outer cutters.

It is still another object of the present invention to provide an electric rotary shaver in which handling of the outer cutters during the attachment and detachment thereof is highly facilitated.

The above objects are accomplished by a unique structure of the present invention for an electric rotary shaver that includes a shaver main body which has a motor inside, a plurality of outer cutters provided in a cutter frame which is mounted on the shaver main body, a plurality of inner cutters provided inside the cutter frame, and drive shafts that protrude from the shaver main body and are rotated by the motor while elastically pressing the inner cutters against the outer cutters; and in the present invention, the electric shaver further includes:

- an outer cutter holder which is provided inside the cutter frame and holds the outer cutters so that the outer cutters are movable in the axial direction and tiltable;
- an inner cutter holder which is formed with a plurality of projections that pass through the outer cutter holder and press the outer circumferential edges of the outer cutters, the inner cutter holder holding the inner cutters so that the inner cutters are free to rotate;
- a shaft member which passes through the inner cutter holder and outer cutter holder with a tip end thereof being positioned in the cutter frame so that the tip end is located between the mutually adjacent outer cutters; and
- a cutter retaining assembly through which the shaft member passes, the cutter retaining assembly being detachably anchored to the cutter frame and elastically pressing the inner cutter holder toward the outer cutters.

As seen from the above, in the electric rotary shaver of the present invention, the round outer cutters are provided in the outer cutter holder so as to be movable in the axial direction and tiltable, a plurality of projections that extend through the outer cutter holder from the inner cutter holder are engaged with the outer circumferential edges of the outer cutters, and the inner cutter holder is elastically pressed by the cutter retaining assembly. Accordingly, when external force acts on the outer cutters during, for instance, shaving, the inner cutter holder is displaced, allowing the outer cutters to be displaced (to make, for instance, an advancing and retracting movement). The projections on the inner cutter holder in this case are not in contact with the entire outer circumferential edges of the outer cutters but instead press the outer cutters with appropriate circumferential gaps (e.g., in two or three locations). Accordingly, the outer cutters can easily tilt, and the amount of displacement of the inner cutter holder is small, thus hardly affecting other outer cutters.

With a simple mechanism as described above, the outer cutters have an increased axial movement range and a tilting range. Furthermore, the number of parts required is small, and a reduction in size and weight is possible. Moreover, since the plurality of outer cutters are provided inside the outer cutter holder so that they are movable in the axial direction and also tiltable, it is possible to remove the plurality of outer cutters while being held "as is" in the outer cutter holder during the cleaning and the like. Thus, the shaver is assured with easy handling.

Furthermore, the shaft member that has the tip end positioned in the cutter frame passes through the cutter retaining assembly that holds the inner cutter holder, and this cutter retaining assembly is detachably attached to the cutter frame so that the inner cutter holder is elastically pressed toward the outer cutters. Accordingly, it is sufficient if the tip end of the shaft member is merely positioned in the cutter frame, and there is no need to anchor this shaft member in a manner that its movement in the axial direction is restricted. Consequently, a shaft member that has a reduced diameter can be used; and as a result, it is possible to make the spacing of the outer cutters small. Thus, for a shaver that has two outer cutters, both outer cutters can be disposed close to each other, so that a reduction in size of the cutter frame is possible. For a shaver that involves three outer cutters, the tip end of the shaft member is anchored in the center of three outer cutters, and thus the space required for anchoring the shaft member can be small, the outer cutters may have a reduced diameter, and it is possible to reduce the size of the cutter frame.

In the above structure, it is preferable that the cutter retaining assembly is comprised of: a locking member which is provided on the shaft member, is prevented from slipping off of the opposite tip end of the shaft member, and is formed with a plurality of arm portions that extend radially outward; and a compression coil spring which is mounted on the locking member to press the inner cutter holder toward the outer cutters; and in this structure, the distal ends of the arm portions are formed so that they are engageable with the inside walls of the cutter frame. In a shaver with two outer cutters, the locking member is formed with a pair of (or two) arm portions; and in a shaver with three outer cutters, the locking member is formed with three arm portions that are provided preferably at equal intervals in the circumferential direction.

In addition, in the present invention, the locking member is rotatable on the shaft member, so that the distal ends of the arm portions of the locking member come into an engagement with (and anchored to) the engaging portions, which are formed on the inside walls of the cutter frame, from a predetermined rotational direction. Since this structure is simple, it reduces the number of parts required. In the present invention, however, the arm portions can be anchored to the cutter frame by some other structures. For instance, the arm portions can be formed so that they can advance and retract in the direction of the distal ends thereof so that the distal ends of the arm portions engage with and disengage from the inside walls of the cutter frame.

The shaft member can be made of a metal such as stainless steel or the like. If made of metal, then the diameter of the shaft member can be made sufficiently small, so that the above-described outer cutter spacing can be further reduced.

Furthermore, in the present invention, it is preferable that the projections that are formed on the inner cutter holder and press the outer circumferential edges of the outer cutters be formed two or three for each outer cutter. In a two-projection structure, the outer cutters can easily tilt in a seesaw fashion with the projections as supporting points. In a three-projection structure, the outer cutters can be easily held in a stable fashion; and by way of varying the layout and spacing of the projections, directions of inclination of the outer cutters can increase, and the outer cutters have a larger degree of movement and have a larger degree of freedom in design.

In the present invention, the outer cutter holder can be pressed against the cutter frame by a plurality of supporting projections that protrude from the shaver main body. In this structure, the outer cutter holder is held between the cutter frame and the supporting projections, and thus the outer cutter holder can be fixed even during the displacement of the outer cutters, so that the outer cutters make smooth movement.

In the case of a shaver with two outer cutters, the tip end of the shaft member is anchored between the two outer cutters and on an imaginary straight line that connects the centers of the outer cutters. In a shaver with three outer cutters that are disposed at vertices of an imaginary equilateral triangle, the tip end of the shaft member is anchored at the center of the triangle.

DETAILED DESCRIPTION OF THE INVENTION

Figure 1:
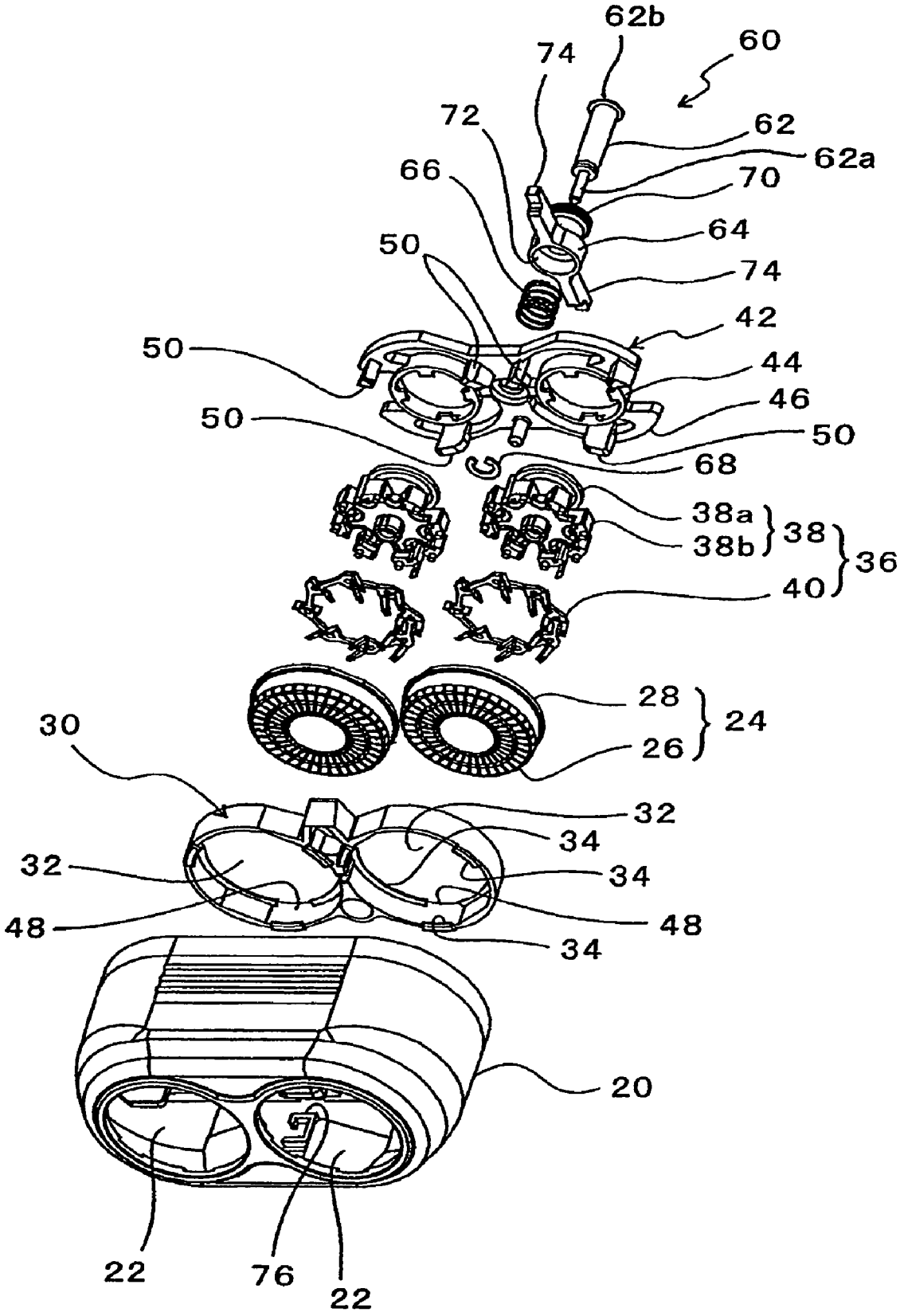
FIG. 1 is a disassembled perspective view of the electric rotary shaver according to one embodiment of the present invention.
Figure 2:
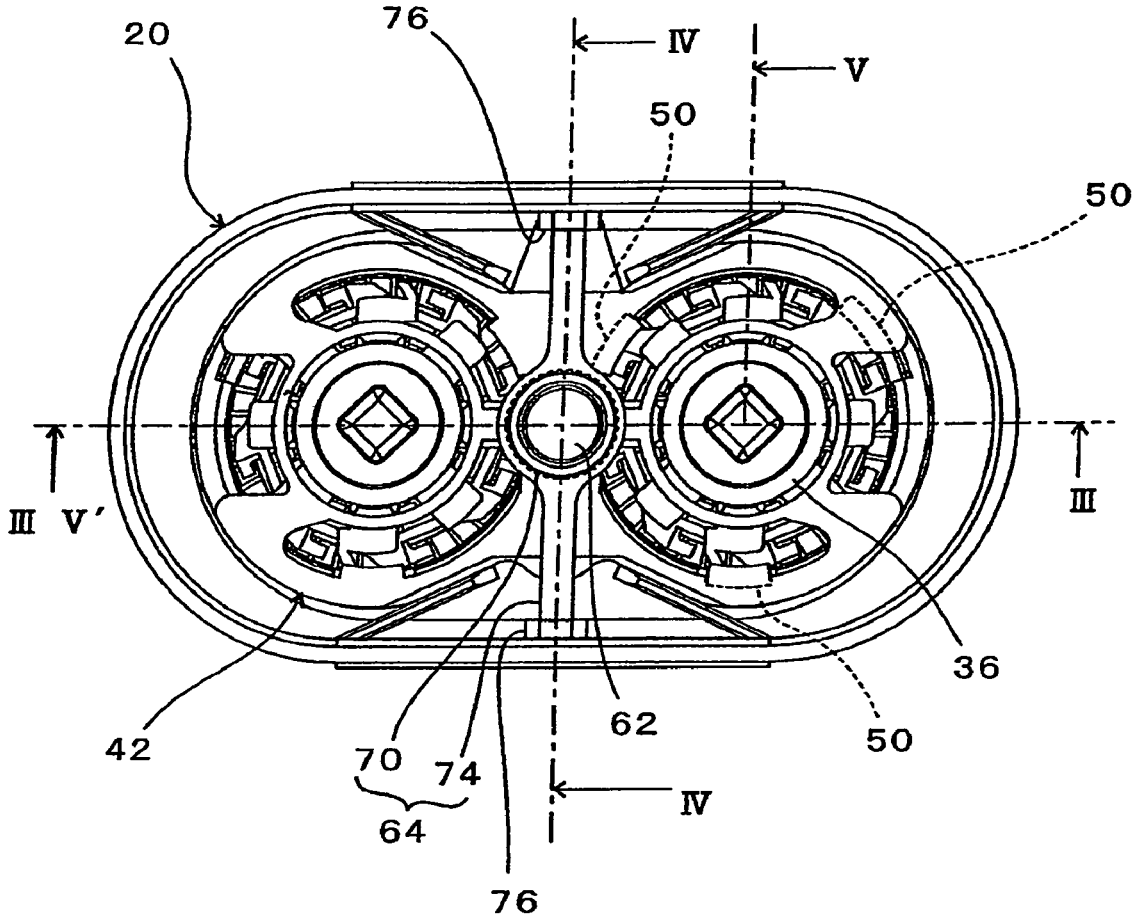
FIG. 2 is a top view of the assembled shaver of the present invention viewed from the inside of the cutter frame.

In FIGS. 1 through 6, the reference numeral 20 is a cutter frame that has a substantially oval shape (or a bathtub shape) when seen from above. A pair of outer cutter mounting holes 22 are formed in the upper surface (which is the "bottom surface" in FIG. 1) of cutter frame 20. The reference numerals 24 refer to outer cutters, and the outer cutters 24 have a substantially circular disk form cap shape, and numerous slits 26 are formed in a radial configuration in the circular top face. The outer circumferential edge of the open end of each outer cutter 24 is bent radially outward to form a flange 28.

The reference number 30 refers to an outer cutter holder that holds the outer cutters 24, which are disposed side by side, so that the outer cutters 24 are movable in the axial direction and also tiltable. The outer cutter holder 30 has two outer cutter openings 32 which correspond to the outer cutter mounting holes 22 of the cutter frame 20, and claws 34 which engage with the flanges 28 of the outer cutters 24 are formed inside the inner circumferential edges of the outer cutter openings 32 at equal intervals (spacedly) in the circumferential direction. Upon installation, the outer cutters 24 are positioned in the outer cutter openings 32 while pushing open some of the claws 34 with their flanges 28, so that the outer cutters 24 are set in the outer cutter holder 30 so that the outer cutters 24 are movable in the axial direction and tiltable within the spacing of the claws 34 that are separated in the axial direction. The outer cutter holder 30 that has the two outer cutters 24 thus installed is disposed inside the cutter frame 20. When the outer cutter holder 30 is thus inside the cutter frame 20, then with the flanges 28 of the outer cutters 24 remaining inside the cutter frame 20, the rest (that includes the round top faces having the slits 26) of the outer cutters 24 protrude to the outside of the outer cutter mounting holes 22 of the cutter frame 20.

The reference numeral 36 refers to inner cutters. Each of the inner cutters 36 is comprised of an inner cutter base body 38, which is made of a synthetic resin and has numerous arm elements **38*b* that extend radially from a cup-form base end 38*a*, and a cutter blade connecting body 40, which is of an annular shape and fastened to the tip ends of the arm elements 38*b*. The annular cutter blade connecting body 40 is a component in which numerous cutter blades that make a sliding contact with the inside surfaces of the outer cutters 24** are connected and integrally formed in an annular shape.

These inner cutters 36 are held in the inner cutter holder 42 so that the inner cutters can be rotated. As is clear from, for instance, FIGS. 1, 2 and 6, the inner cutter holder 42 is in a substantially numeral "8" shape and is formed with a pairs of inner rings 44 and outer rings 46. The outer rings 46 are formed so as to surround the outsides of the inner rings (except for certain portions). The base ends **38*a* of the inner cutters 36 are held in the inner rings 44 so that the inner cutters 36 can rotate and can move in the axial direction. As seen from FIGS. 1, 5 and 6, each of the outer rings 46 is formed with three projections 50 that are pressed against the flanges 28 of the outer cutters 24 through three cut-outs 48 (see FIGS. 1 and 6) formed in the outer cutter holder 30. Though not shown in the drawings, two (instead of three) projections 50 that are pressed against the flanges 28 of the outer cutters 24 can be formed diagonally on the edge of each outer ring 46 so that they correspond to two cut-outs 48 formed in the outer cutter holder 30**.

Furthermore, the shaver of the present invention is provided with a cutter retaining assembly 60. The cutter retaining assembly 60 is comprised of, as best seen from FIG. 1, a shaft member 62, a locking member 64, a compression coil spring 66 and a locking ring 68. The shaft member 62 is made of metal (e.g., stainless steel) and passes through the inner cutter holder 42 and outer cutter holder 30, and the tip end of the shaft member 62 is positioned in the center of the cutter frame 20 so that the tip end of the shaft member 62 is positioned on an imaginary straight line that connects centers of the two outer cutters 24. The locking member 64 is mounted on the shaft member 62. The shaft member 62 has a small diameter portion **62*a* at its tip end; and this small diameter portion 62*a* and the portion near the small diameter portion are successively engaged with the inner cutter holder 42 and the outer cutter holder 30 so that the inner cutter holder 42 and the outer cutter holder 30 overlap in the axial direction of the shaft member 62. The other end of the shaft member 62 which is the opposite end from the small diameter portion 62*a* is formed with a flange 62*b* that prevents the locking member 64** from being is prevented from slipped off.

Figure 3:
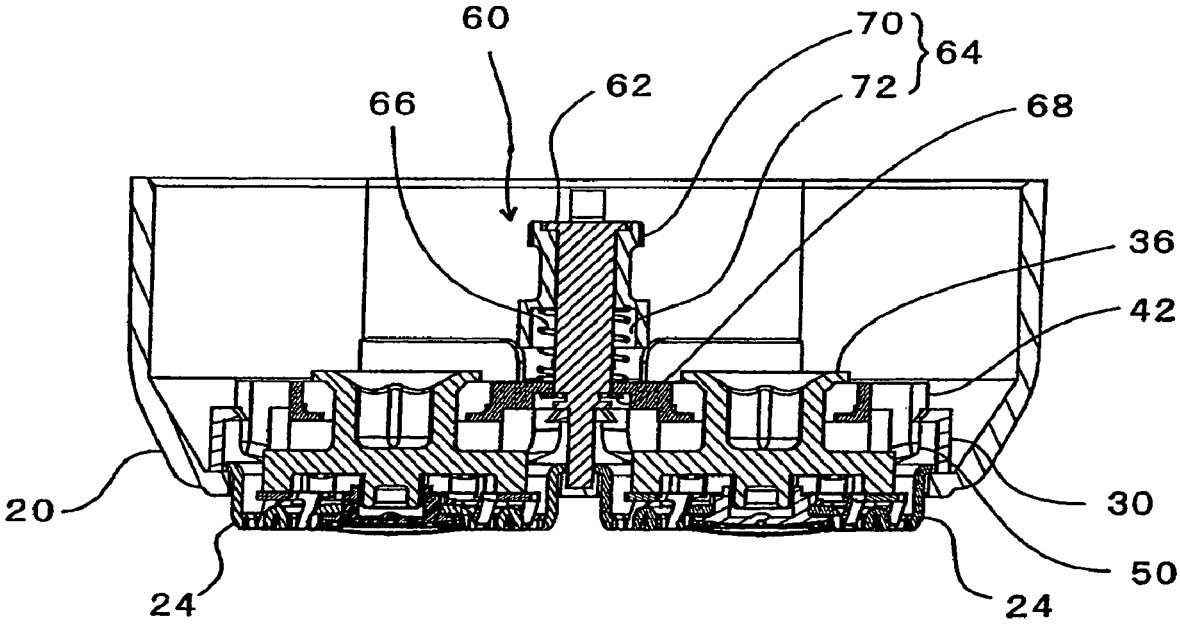
FIG. 3 is a sectional view taken along the line III-III in FIG. 2.
Figure 4:
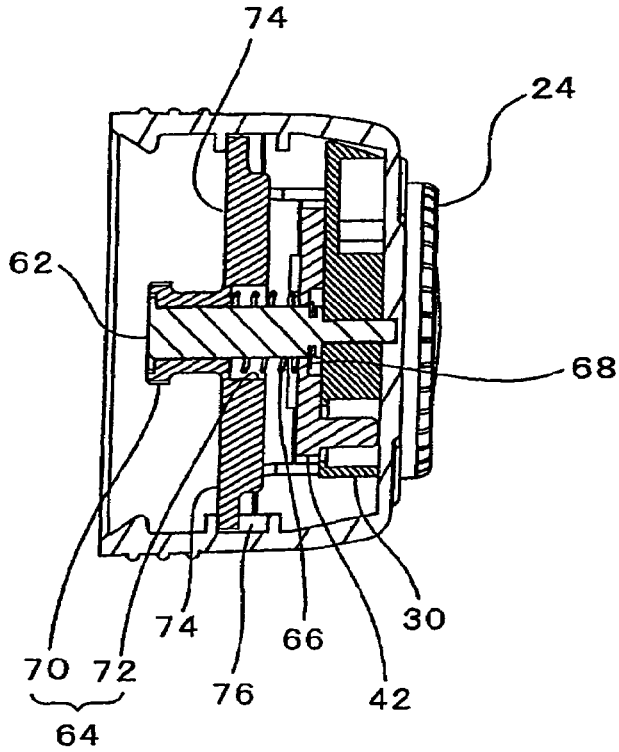
FIG. 4 is a sectional view taken along the line IV-IV in FIG. 2.
Figure 5:
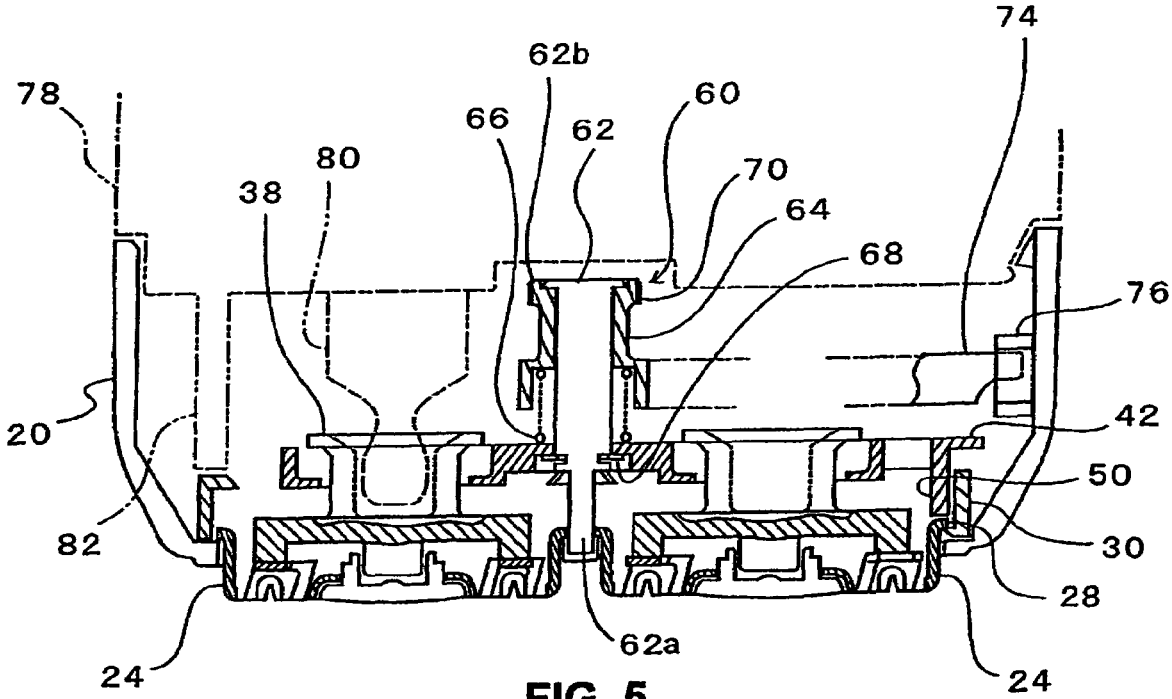
FIG. 5 is a sectional view taken along the line V-V in FIG. 2.
Figure 6:
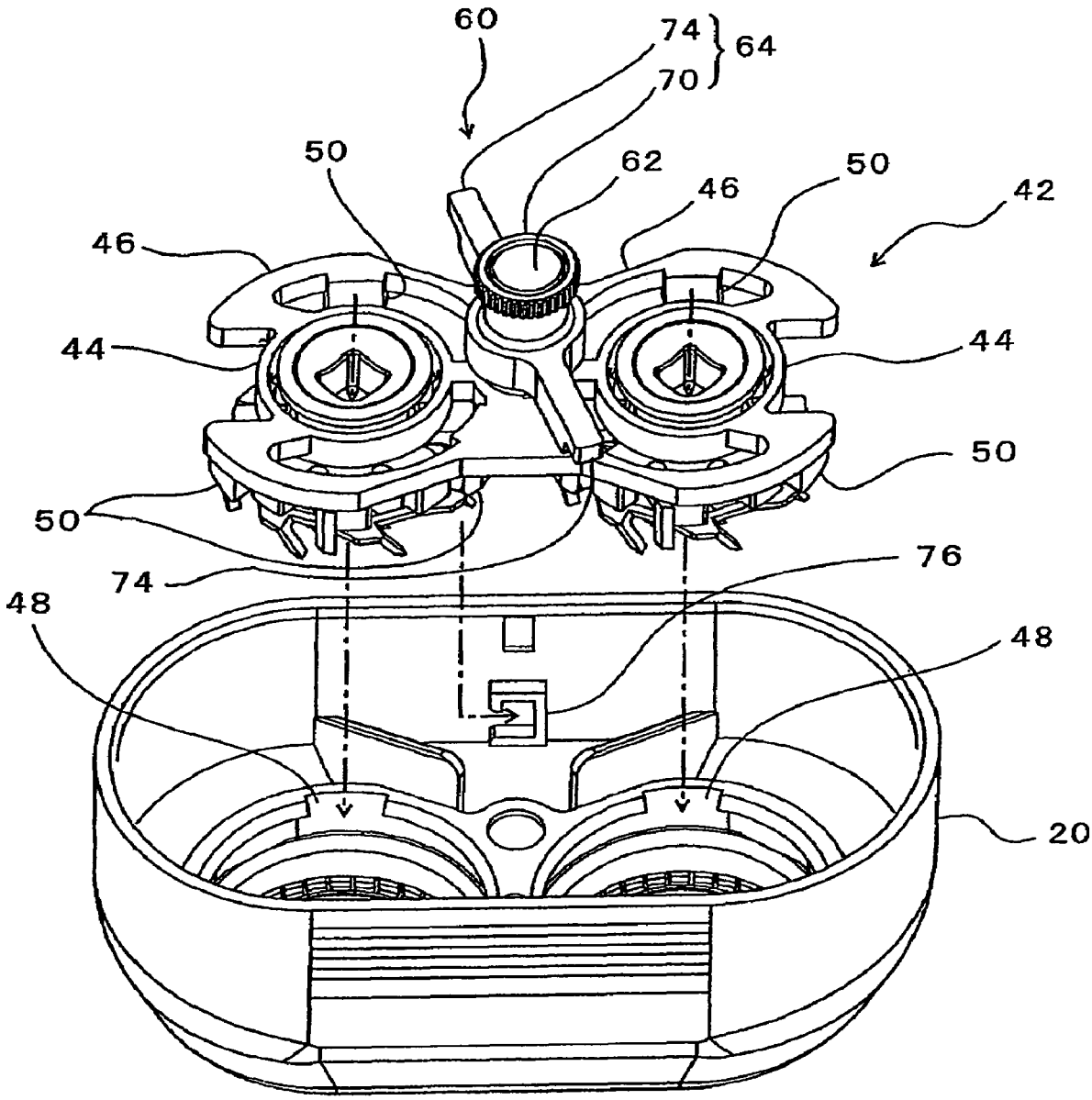
FIG. 6 is a perspective view of the cutter retaining assembly.
Figure 7:
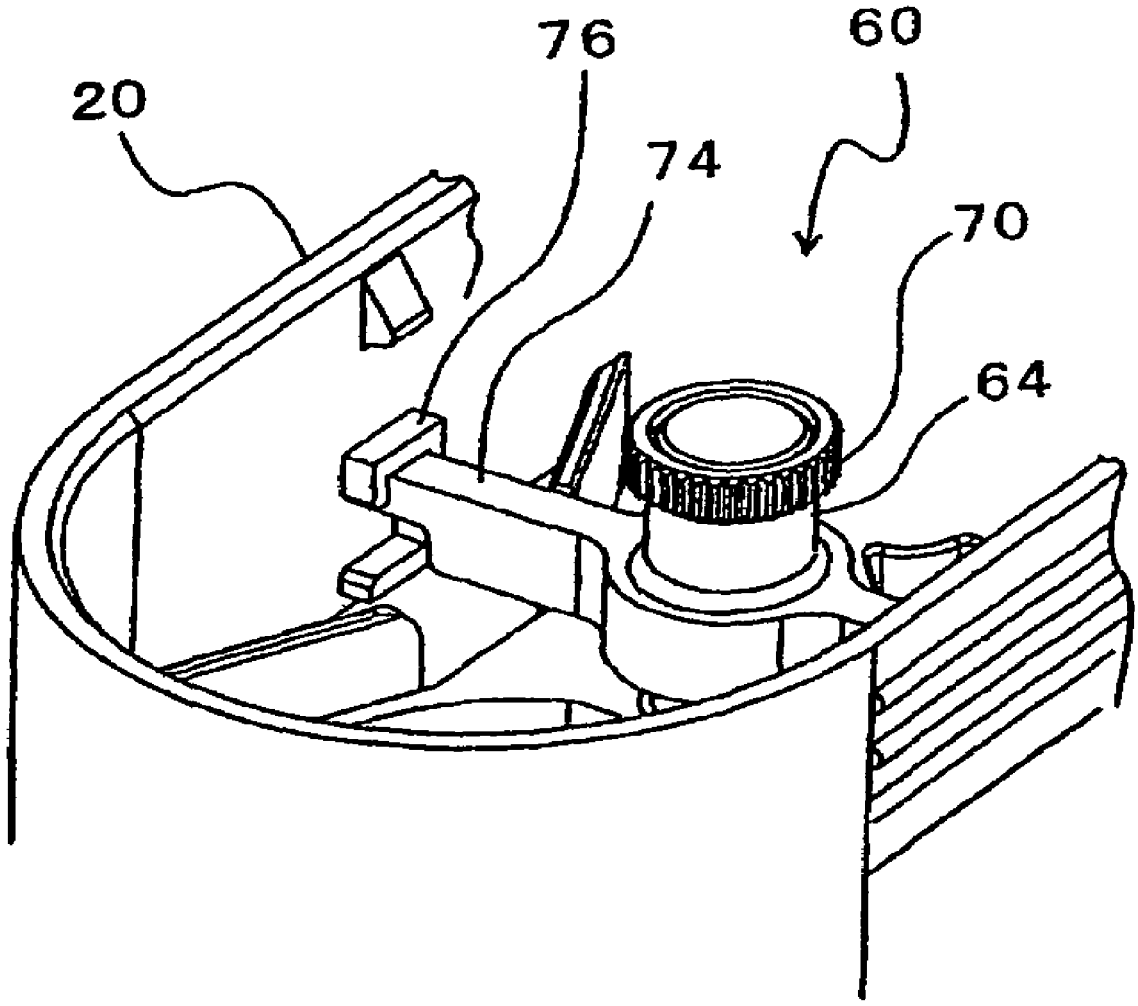
FIG. 7 is an enlarged view of the cutter retaining assembly, showing a part thereof.
Figure 8:
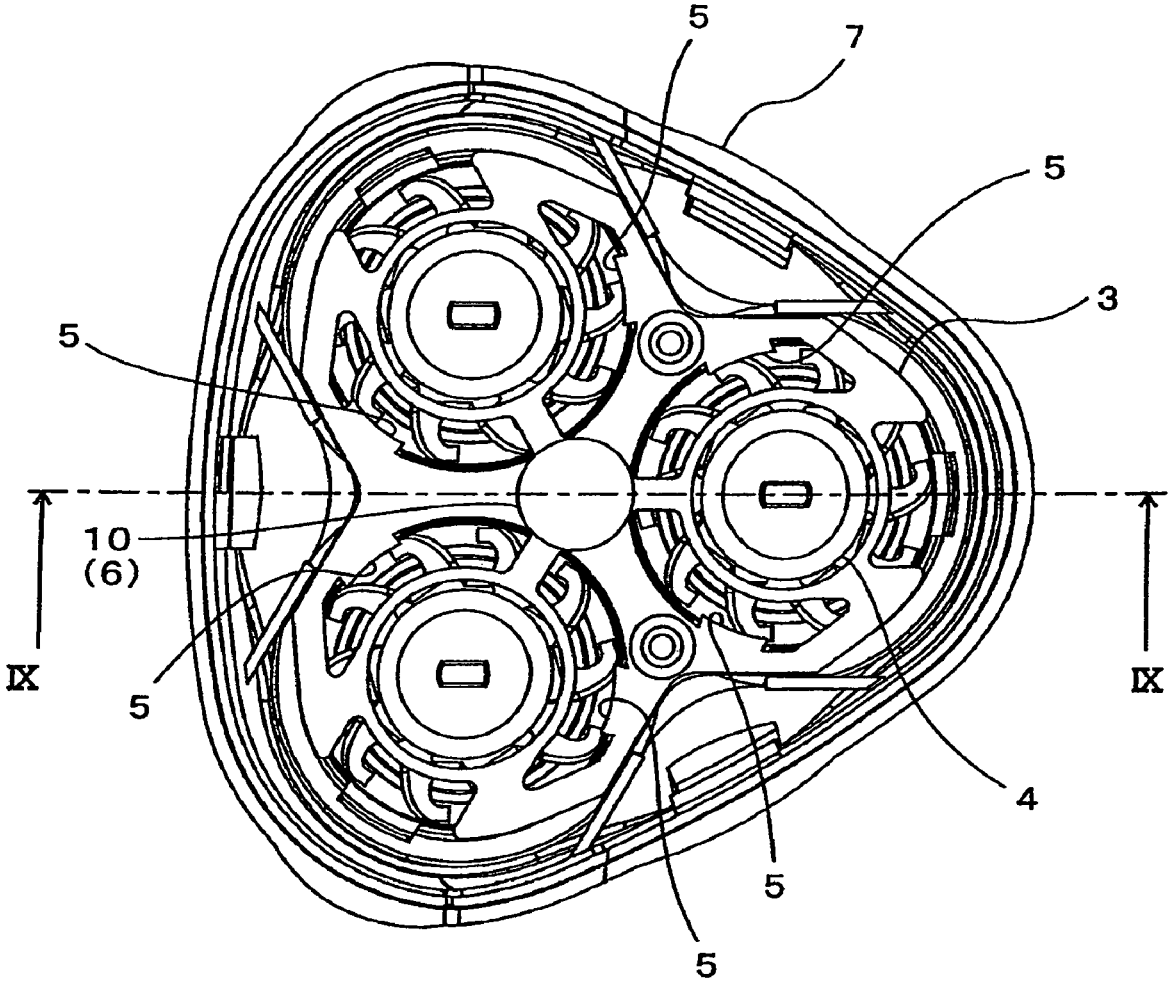
FIG. 8 PRIOR ART
FIG. 8 is a top view of the internal structure of a conventional cutter frame.
Figure 9:
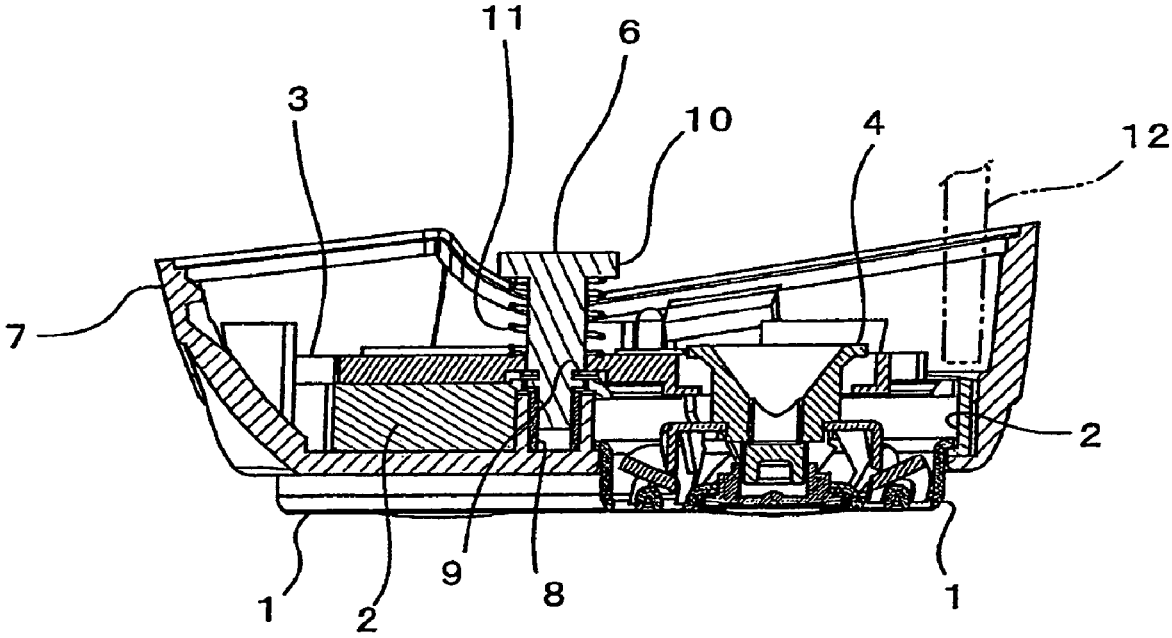
FIG. 9 PRIOR ART
FIG. 9 is a sectional view taken along the line IX-IX in FIG. 8.

As seen from FIGS. 3 and 5, the locking member 64 has a knob 70 that is integrally formed at one end (the upper end in FIGS. 3 and 5) thereof, and a spring mounting chamber 72 is formed at another end (the lower end in FIGS. 3 and 5) of the locking member 64 to open downward (in FIGS. 3 and 5). The coil spring 66 is installed inside the spring mounting chamber 72, and the lower end of the coil spring 66 is provided so as to be in contact with the upper surface of the inner cutter holder 42 and to push the inner cutter holder 42 downward or toward the outer cutter 24. The inner cutter holder 42 is prevented from slipping of off the shaft member 62 by the locking ring 68 that is mounted on the shaft member 62.

The locking member 64 further has a pair of arm portions 74 that are integrally formed on the locking member 64 and extend in the radial direction (or opposite directions). The distal ends of the arm portions 74 are engageable with the inside walls of the cutter frame 20. More specifically, a pair of substantially C-shaped engaging portions 76 which open in the horizontal direction (or open in the counterclockwise direction in FIGS. 2 and 6) are formed on the inside walls of the cutter frame 20 that are on the short-diameter sides of the oval-shape cutter frame 20 and face each other, so that the arm portions 74 of the locking member 64 simultaneously come into an engagement with the engaging portions 76 of the cutter frame 20 when an operator grasping the knob 70 rotates the locking member 64 in, for example, the clockwise direction in FIG. 6. When thus engaging the distal ends of the arm portions 74 with the engaging portions 76 so as to attach the inner cutter holder 42 to the cutter frame 20, it is preferable that the operator presses the inner cutter holder 42 against the outer cutter holder 30 while compressing the coil spring 66 by pushing in the knob 70. Likewise, when the outer cutter holder 42 are to be removed from the cutter frame 20, such an removal is accomplished by turning the locking member 64 in the counterclockwise direction while pushing the knob 70 toward the outer cutter frame 20.

As seen from the above, by successively mounting the outer cutter holder 30 that has the outer cutters 24 and the inner cutter holder 42 that has the inner cutters 36 in the cutter frame 20, and then by rotating the knob 70 of the locking member 64 attached to the inner cutter holder 42 in the clockwise direction while pressing the knob 70 toward the outer cutter frame 20 so that the arm portions 74 are engaged with the engaging portions 76, the outer cutter holder 30 having the outer cutters 24 and the inner cutter holder 42 having the inner cutters 36 are installed in the cutter frame 20. When this cutter frame 20, in which the outer cutter holder 30 having the outer cutters 24 and the inner cutter holder 42 having the inner cutters 36 are thus installed, is mounted on the shaver main body 78, as shown in FIG. 5, the drive shafts 80 are engaged with the base ends 38*a* of the inner cutters 36. Since the drive shafts 80 have a return habit in the direction of protrusion (or toward the bottom in FIG. 5) and are rotationally driven by the motor (not shown) installed inside the shaver main body, the inner cutters 36 are rotated by the drive shafts 80 while being elastically pressed against the inside surfaces of the outer cutters 24. The supporting projections 82 that project from the shaver main body 78 press the outer cutter holder 30 and thus hold the outer cutter holder 30.

In the above structure, the outer cutters 24 are disposed in the outer cutter holder 30 so that they are movable in the axial direction and also tiltable. In addition, three projections 50 on the inner cutter holder 42 are in contact with the flanges 28 of the outer cutters 24, and thus the inner cutter holder 42 is elastically pressed by the cutter retaining assembly 60 (more specifically by the coil spring 66 of the cutter retaining assembly 60). Accordingly, when an external force is applied to any one of the outer cutters 24 while, for instance, shaving, the inner cutter holder 42 undergoes displacement by the projections 50 in the axial direction of the shaft 62, and the outer cutter 24 makes an advancing and retracting movement in the axial direction and makes a tilting motion. Since the three projections 50 press the flange 28 of the outer cutter 24 at different three locations, the outer cutter 24 can tilt smoothly and easily. When the projections 50 press the flange 28 of the outer cutter 24, the inner cutter holder 42 is pressed; however, since this displacement of the inner cutter holder 42 is small, influence to other outer cutters 24 is small. Since the range of possible movement (or possible displacement) of the inner cutter holder 42 can be increased by the cutter retaining assembly 60, the range of possible movement (in the axial direction) of the outer cutters 24 can also increase.

The cutter retaining assembly 60 allows the arm portions 74 of the locking member 64 held on the shaft member 62 to come into contact with the inside walls of the cutter frame 20, and the compression coil spring 66 is provided between the locking member 64 and the inner cutter holder 42. Accordingly, it is sufficient for the shaft member 62 if it has the function of positioning the locking member 64, inner cutter holder 42 and outer cutter holder 30; and there is no need for the shaft member 62 to be prevented from slipping off of the cutter frame 20. Consequently, the tip end portion of the shaft member 62 may have a sufficiently small diameter, so that the outer cutter holder 30 and inner cutter holder 42 are held in an overlapping fashion in the axial direction. Accordingly, the flanges 28 of the two outer cutters 24 can be positioned close to each other to a sufficient degree, allowing a reduction in the size of the cutter frame 20 and a reduction in the size of the electric shaver as a whole.

Furthermore, the locking member 64 is provided so that it can rotate on the shaft member 62 and can also move on the shaft member 62 in its axial direction. Accordingly, the distal ends of the arm portions 74 come into an engagement with the engaging portions 76 of the cutter frame 20 when an operator merely grasps the knob 70 of the locking member 64, puts the inner cutter holder 42 inside of the cutter frame 20 and then turns the knob 70 in a predetermined direction (the clockwise direction in the shown structure) while pushing in this knob 70. Thus, operation is easy. If the inner cutter holder 42 is detached from the cutter frame 20 for, for instance, the cleaning of shaving debris, the inner cutters 36 are removed together with the inner cutter holder 42. Furthermore, the outer cutters 24 can be removed from the cutter frame 20 together with the outer cutter holder 30. Cleaning can be done more easily if the respective elements are thus disassembled.

The above description is made mainly for a shaver that includes two outer cutters and two inner cutters with the outer (inner) cutters are set side by side; and the cutter frame 20, the outer cutter holder 30 and the inner cutter holder 42 are in substantially an oval shape with the locking member 64 having two arm portions 74 that extend in the opposite directions. The present invention is indeed applicable, as describe above, to a rotary shaver that includes three outer cutters and three inner cutters with the outer (inner) cutters are disposed in a triangle shape. In this shaver, though not shown in the drawings, the cutter frame (20), the outer cutter holder (30) and the inner cutter holder (42) take substantially an equilateral triangle shape, and three outer cutters and inner cutters are positioned at vertices of an imaginary equilateral triangle. In addition, the locking member (64) has three arm portions (74) that extend outward from the center at 120 degrees apart from each other, and three substantially C-shaped engaging portions (76) which open in the horizontal direction are formed on the inside walls of the triangle cutter frame (20) that correspond to the three sides of a triangle, so that the distal ends of the three arm portions of the locking member come into engagement with the three engaging portions, respectively, thus holding the inner cutter holder, inner cutters, outer cutters and outer cutter holder within the cutter frame, when the tip end of the shaft member (62) is positioned at the center of the equilateral triangle (or at the center of the triangle cuter frame).

The invention claimed is:

1. An electric rotary shaver comprising:

a shaver main body that contains a motor, two outer cutters provided in a cutter frame which is mounted on said shaver main body, two inner cutters provided inside of said cutter frame, and two drive shafts that protrude from said shaver main body and are rotationally driven by said motor while elastically pressing each of said two inner cutters respectively against a corresponding one of said two outer cutters;

said electric shaver further comprising:

an outer cutter holder which is provided inside of said cutter frame and holds said two outer cutters;

an inner cutter holder which is formed with a plurality of projections that pass through said outer cutter holder and press against outer circumferential edges of said two outer cutters, said inner cutter holder holding said two inner cutters so that said two inner cutters are free to rotate;

a shaft member which passes through said inner cutter holder and said outer cutter holder with a tip end of said shaft member being positioned in said cutter frame so as to be located between mutually adjacent said two outer cutters; and a cutter retaining assembly through which said shaft member passes, said cutter retaining assembly being detachably anchored to said cutter frame and elastically pressing said inner cutter holder toward said two outer cutters; and wherein said tip end of said shaft member is positioned on an imaginary straight line that connects centers of said two outer cutters; and said cutter retaining assembly comprises:

a locking member which is provided on said shaft member and is prevented from slipping off of said shaft member, said locking member being formed with a plurality of arm portions that extend radially outward, and a compression coil spring which is mounted on said locking member and presses said inner cutter holder toward said outer cutters; and wherein distal ends of said arm portions are engageable with inside walls of said cutter frame.

2. The electric rotary shaver according to claim 1, wherein said locking member is rotatable on said shaft member, so that said distal ends of said arm portions come into an engagement with engaging portions formed on said inside walls of said cutter frame.

3. The electric rotary shaver according to claim 1, said shaft member is made of metal.

4. The electric rotary shaver according to claim 1, wherein said projections that are formed on said inner cutter holder and press said outer circumferential edges of said outer cutters are formed at least two for each outer cutter.

5. An electric rotary shaver comprising:

a shaver main body that contains a motor, two outer cutters provided in a cutter frame which is mounted on said shaver main body, two inner cutters provided inside of said cutter frame, and two drive shafts that protrude from said shaver main body and are rotationally driven by said motor while elastically pressing each of said two inner cutters respectively against a corresponding one of said two outer cutters;

said electric shaver further comprising:

an outer cutter holder which is provided inside of said cutter frame and holds said two outer cutters;

an inner cutter holder which is formed with a plurality of projections that pass through said outer cutter holder and press against outer circumferential edges of said two outer cutters, said inner cutter holder holding said two inner cutters so that said two inner cutters are free to rotate;

a shaft member which passes through said inner cutter holder and said outer cutter holder with a tip end of said shaft member being positioned in said cutter frame so as to be located between mutually adjacent said two outer cutters; and a cutter retaining assembly through which said shaft member passes, said cutter retaining assembly being detachably anchored to said cutter frame and elastically pressing said inner cutter holder toward said two outer cutters; and wherein said tip end of said shaft member is positioned on an imaginary straight line that connects centers of said two outer cutters; and said outer cutter holder is held between said cutter frame and said supporting projections formed on said inner cutter holder.

* * * * *